US006497774B2

(12) United States Patent
Yamato et al.

(10) Patent No.: US 6,497,774 B2
(45) **Date of Patent: *Dec. 24, 2002**

(54) GAS GENERANT FOR AIR BAG

(75) Inventors: Yo Yamato, Hyogo (JP); Norimasa Hirata, Hyogo (JP); Takeshi Takahori, Hyogo (JP); Takushi Yokoyama, Hyogo (JP); Naoki Matsuda, Hyogo (JP)

(73) Assignee: Daicel Chemical Industries, Ltd., Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/739,809

(22) Filed: Dec. 20, 2000

(65) Prior Publication Data

US 2001/0000383 A1 Apr. 26, 2001

Related U.S. Application Data

(62) Division of application No. 09/401,324, filed on Sep. 23, 1999, which is a division of application No. 08/832,610, filed on Mar. 31, 1997.

(30) Foreign Application Priority Data

Jul. 22, 1996 (JP) ..... 8-192294
Jul. 31, 1996 (JP) ..... 8-201802

(51) Int. Cl.[7] ..... C06B 31/00; C06B 31/02; C06B 25/00

(52) U.S. Cl. ..... 149/45; 149/61; 149/88

(58) Field of Search ..... 149/61, 45, 46, 149/88, 109.6

(56) References Cited

U.S. PATENT DOCUMENTS

| | | | | | |
|---|---|---|---|---|---|
| 3,715,983 | A | * | 2/1973 | Rosinski | 241/1 |
| 4,352,699 | A | * | 10/1982 | Zeigler, Jr. | 149/109.6 |
| 4,386,979 | A | | 6/1983 | Jackson, Jr. | |
| 4,818,373 | A | * | 4/1989 | Bartholic et al. | 208/252 |

(List continued on next page.)

FOREIGN PATENT DOCUMENTS

| | | | |
|---|---|---|---|
| DE | 2357303 | | 5/1975 |
| DE | 94161127 | | 12/1994 |
| DE | 94161127 | | 2/1995 |
| DE | 4411654 | A1 | 4/1995 |
| DE | 19548917 | A1 | 7/1996 |
| EP | 0607446 | A1 | 7/1994 |
| EP | 0619284 | A1 | 10/1994 |
| EP | 091253 | A2 | 7/1995 |
| EP | 0673809 | A1 | 9/1995 |
| EP | 0722429 | B1 | 3/1999 |
| WO | 4962575 | | 8/1996 |

*Primary Examiner*—Michael J. Carone
*Assistant Examiner*—Aileen J. Baker
(74) *Attorney, Agent, or Firm*—Birch, Stewart, Kolasch & Birch, LLP

(57) ABSTRACT

A gas-generant-molded-article for air bags which is prepared by molding a gas generant composition into a cylindrical form containing an opening hole, wherein the relationship between the linear burning velocity r (mm/second) of said gas generant composition under a pressure of 70 kgf/cm$^2$ and a thickness W (mm) of said molded article falls within a range represented by $0.005 \leqq W/(2 \cdot r) \leqq 0.3$, with the linear burning velocity preferably falling within a range of from 1 to 12.5 mm/second.

10 Claims, 1 Drawing Sheet

U.S. PATENT DOCUMENTS 5,028,284 A * 7/1991 Cox et al. ..... 149/21
5,125,684 A 6/1992 Cartwright
5,403,035 A * 4/1995 Hamilton ..... 280/736
5,487,851 A 1/1996 Dillehay et al.
5,507,891 A 4/1996 Zeigler
5,520,756 A 5/1996 Zeigler
5,542,998 A 8/1996 Bucerius et al.
5,542,999 A 8/1996 Bucerius et al.
5,608,183 A 3/1997 Barnes et al.
5,616,883 A * 4/1997 Hamilton et al. ..... 102/288
5,756,929 A 5/1998 Lundstrom et al. ..... 149/61 X
5,780,767 A 7/1998 Matsuda et al. ..... 149/2
5,780,768 A 7/1998 Knowlton et al. ..... 149/45
5,788,275 A * 8/1998 Butt et al. ..... 280/737
5,817,972 A 10/1998 Butt et al. ..... 149/109.2
5,866,842 A * 2/1999 Wilson et al. ..... 149/19.6
5,872,329 A 2/1999 Burns et al. ..... 149/36
5,898,126 A 4/1999 Yoshida et al. ..... 149/46

* cited by examiner

GAS GENERANT FOR AIR BAG

This is a division of application Ser. No. 09/401,324, filed Sep. 23, 1999, which is a division of application Ser. No. 08/832,610, filed Mar. 31, 1997.

FIELD OF THE INVENTION

The present invention relates to a gas-generant-molded-article which is combusted to form gas components in order to expand an air bag system, and a process for producing the same. More specifically, the present invention relates to a novel gas generant composition that produces operating gases in air bag systems that are carried in automobiles and aircraft and used for protecting human bodies.

DESCRIPTION OF THE RELATED ART

Air bag systems are known in which a bag is quickly expanded by gas to prevent occupants from violently colliding against damaging spots and/or hard parts inside vehicles (such as handles and windshields) by inertia when vehicles such as automobiles collide at a high speed. Requirements for gas generants used for air bag systems are very severe, such that bag expansion time is very short, usually 40 to 50 milliseconds, and, further, the gaseous atmosphere in the bag should be harmless to a human body (e.g., close to the air composition in a car).

At present, gas generants usually used for air bag systems include inorganic azide compounds, particularly sodium azide. Sodium azide does not satisfy the requirements described above in terms of safety to occupants since an alkali component which is produced as a by-product in the generation of gas shows toxicity, though sodium azide is excellent in terms of combustibility. Further, since sodium azide itself also shows toxicity, influences that it exerts on the environment when it is thrown away are also of concern.

In order to overcome these defects, some, so-called non-azide gas generants have been developed and substituted for sodium azide gas generants. For example, a composition comprising, as its principal components, tetrazole, triazole or metal salts thereof, and oxygen-containing oxidizing agents such as alkaline metal nitrates is disclosed in JP-A-3-208878. Further, gas generants comprising, as their principal components, metal salts of bitetrazole compounds containing no hydrogen are disclosed in JP-B-64-6156 and JP-B-64-6157.

Furthermore, a gas generant containing a transition metal complex of tetrazole or triazole is shown in JP-B-6-57629. Also, a gas generant containing triaminoguanidine nitrate is shown in JP-A-5-254977; a gas generant containing carbohydrazide is shown in JP-A-6-239683; and a gas generant containing nitrogen-containing non-metal compounds including cellulose acetate and nitroguanidine is shown in JP-A-7-61855. Further, the use of nitroguanidine as an energy material which coexists with 15 to 30% of a cellulose binder is disclosed in U.S. Pat. No. 5,125,684. Furthermore, a gas generant composition comprising a combination of tetrazole and triazole derivatives with an oxidizing agent and a slag-forming agent are disclosed in JP-A-4-265292.

However, nitrogen-containing organic compounds have a defect in that they usually generate a large amount of heat during combustion, as compared with azide compounds, when an oxidizing agent sufficient for generating oxygen in an amount corresponding to the chemical equivalent thereof is used (that is, in an amount necessary for combusting carbon, hydrogen and other elements contained in the molecule of the compound). Although it is essential in an air bag system that the system itself have such a size that it is not obstructive in ordinary driving, in addition to the performance of a gas generant, a large calorific value of a gas generant in combustion requires the presence of an optional part for removing heat when designing a gas generator and therefore makes it impossible to miniaturize the gas generator itself. Although a calorific value can also be reduced by selecting the kind of oxidizing agent, linear burning velocity is also reduced accordingly, which results in reduction in gas generating performance.

As described above, a gas generant composition comprising a nitrogen-containing organic compound has had the defect that it usually generates a large amount of heat in combustion, as compared with gas generant compositions using inorganic azide compounds, when an oxidizing agent sufficient for generating oxygen in an amount corresponding to the chemical equivalent thereof is used. As a result of the combustion temperature being high, the linear burning velocity is small.

A problem caused by high combustion temperatures is that bags are damaged by having released out of an inflater (i) a chemical reaction product of alkaline mists generated from the oxidizing agent components contained in the compositions together with (ii) high temperature hot grains that are newly generated in a cooling part by an erosion of a coolant, which is made of stainless steel in many cases. However, if one could also form a slag in the combustion chamber before the mists and hot grains arrive at the cooling part, this could prevent the alkaline mists generated from oxidizing agent components and high temperature hot grains that are newly generated in a combustion chamber from exiting the inflater. In this way, an inflater system using a small amount of a coolant could be realized without fatally damaging the bag, since the generated gases while having high temperatures also have a small heat capacity. Such an achievement also would make it possible to realize an inflater having a smaller size.

Non-azide gas generant compositions using various nitrogen-containing organic compounds including tetrazole derivatives have previously been investigated. Although the linear burning velocities of the compositions vary depending upon the kind of the oxidizing agent combined therewith, almost all such compositions have a linear burning velocity of 30 mm/second or slower.

The linear burning velocity influences the physical form of a gas generant composition for satisfying required performances. In one form of a gas generant composition, the combustion time of the gas generant composition is determined depending upon the smallest thickness of the thicknesses in a thick part thereof and the linear burning velocity of the gas generant composition. A bag expanding time required of inflater systems is about 40 to 60 milliseconds.

In order to completely combust within this time a gas generant composition having a pellet form and one having a disc form are used in many cases. However, a time of 100 milliseconds is required, for example, when the linear burning velocity is 20 mm/second at a thickness of 2 mm, and therefore the required inflater performance for a vehicle air bag cannot be satisfied.

Accordingly, in a gas generant composition having a linear burning velocity of about 20 mm/second, the performances cannot be satisfied when the thickness thereof is not about 1 mm. Thus, in the case where the linear burning velocity is about 10 mm/second or less, it is an essential condition that the thickness of the thick part is even smaller.

Although a means of combining an oxidizing agent such as sodium nitrate and potassium perchlorate therewith in order to increase the linear burning velocity has been known, sodium oxide from sodium nitrate or potassium chloride from potassium perchlorate is released to outside the inflater in a form of a liquid or solid fine powder, and in the case where a slag-forming agent is not present, it is extremely difficult to reduce the amount thereof to be released to an allowable level by conventional filters.

In order to achieve a thickness of a thick part in a pellet form or a disc form used in many cases when the linear burning velocity is about 10 mm/second or less, the thickness of about 0.5 mm or less is essential. However, it is practically almost impossible to produce a gas generant composition having such a thickness when the same is in a pellet form or a disc form, such that it withstands the vibration of automobiles over a long period of time and is industrially stable.

SUMMARY OF THE INVENTION

Extensive investigations repeated by the present inventors in order to solve the problems described above have resulted in the discovery of a novel gas generant composition having a small linear burning velocity, which can be combusted within a specified time by molding it into a specified configuration, and wherein the performance thereof is sufficiently applicable as a gas generant for air bags. Based on this discovery, the present invention has been completed.

That is, in one embodiment the present invention provides a gas-generant-molded-article for air bags which is prepared by molding a gas generant composition into a cylindrical form having an opening hole therein or therethrough, wherein the relationship between the linear burning velocity r (mm/second) of said gas generant composition under a pressure of 70 kgf/cm$^2$ and a thickness W (mm) falls within a range represented by $0.005 \leqq W/(2 \cdot r) \leqq 0.3$, preferably $0.005 \leqq W/(2 \cdot r) \leqq 0.1$, and a gas-generant-molded-article for air bags which is prepared by molding a gas generant composition having a linear burning velocity within the range of preferably from 1 to 12.5 mm/second, still more preferably from 5 to 12.5 mm/second under a pressure of 70 kgf/cm$^2$. In the case of describing a linear burning velocity in the present description, this means the velocity under a pressure of 70 kgf/cm$^2$.

In another embodiment, the invention provides for a novel gas generant composition for air bags, which composition comprises a nitrogen containing organic compound, an oxidizing agent, optionally a slag forming agent, and a binder. The provided composition can advantageously be used in preparing a gas-generant-molded-article for air bags according to the present invention.

DETAILED DESCRIPTION OF THE INVENTION

Figure 1:
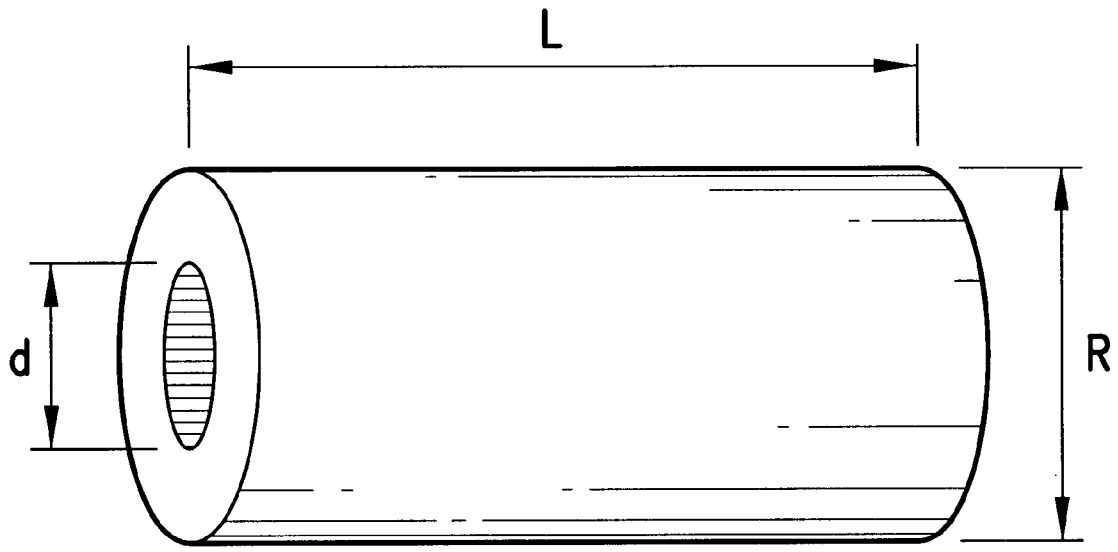
FIG. 1 shows an appearance of the gas-generant-molded-article for air bags according to the present invention, wherein L represents a length; R represents an outer diameter; and d represents an inner diameter.

The gas generant composition used in the present invention is prepared by adding a binder and, if necessary, a slag-forming agent to a nitrogen-containing organic compound and an oxidizing agent. In order to suppress heat generation, a gas generant composition having a linear burning velocity falling within a range of from 1 to 12.5 mm/second is preferably used.

The present invention has made it possible to apply the gas generant composition having a linear burning velocity of about 10 mm/second or less to the production of vehicle air bags and further has made it possible to put a more miniaturized inflater system including the qualities of the resulting gases formed to a practical use.

The nitrogen-containing compound capable of being used in the present invention is at least one member selected from the group consisting of triazole derivatives, tetrazole derivatives, guanidine derivatives, azodicarbonamide derivatives and hydrazine derivatives, or a mixture of more than one member thereof.

Specific examples thereof include, e.g., 5-oxo-1,2,4-triazole, tetrazole, 5-aminotetrazole, 5,5'-bi-1H-tetrazole, guanidine, nitroguanidine, cyanoguanidine, triaminoguanidine nitrate, guanidine nitrate, guanidine carbonate, biuret, azodicarbonamide, carbohydrazide, carbohydrazide nitrate complex, dihydrazide oxalate, and hydrazine nitrate complex.

Nitroguanidine and cyanoguanidine are preferred, and nitroguanidine is the most preferred compound in view of a small carbon atom number in the molecule. Nitroguanidine includes needle-crystalline nitroguanidine having a low specific gravity and nitroguanidine of massive crystal size having a high specific gravity, and either of them can be used in the present invention. However, the use of nitroguanidine having a high specific gravity is more preferable from the viewpoints of safety when producing in the presence of a small amount of water and easiness in handling.

Although the concentration of the compound varies depending upon the amount of the carbon element, the hydrogen element and other elements to be oxidized in the molecule, it is used usually in the range of from 25 to 60% by weight, preferably in the range of from 30 to 40% by weight. Although the absolute numerical value varies depending upon the kind of oxidizing agent used, when it is larger than the complete oxidation theoretical amount, the concentration of CO contained at trace amounts in the generated gas increases. However, when it is used in the same as or less than the complete oxidation theoretical amount, the concentration of $NO_x$ contained at trace amounts in the generated gas increases. A range where both gases are maintained at an optimum balance is most preferred.

Dicyandiamide can also preferably be used as the nitrogen-containing agent. In the case of using dicycandiamide, the amount thereof is preferably in the range of 8 to 20% by weight.

Although various oxidizing agents can be used, an oxidizing agent selected from among at least one member of nitrates containing cations selected from among alkali metals or alkaline earth metals is preferably used. With respect to the amount thereof, although the absolute numerical amount varies depending upon the kind and the amount of the gas generant compound to be used, the oxidizing agent is usually present within the range of from 40 to 65% by weight, and in, particular, the range of from 45 to 60% by weight is preferable in relation to the CO and $NO_x$ concentrations described above.

In addition to those mentioned above, oxidizing agents used in the air bag inflater field in many cases, such as nitrites and perchlorates, can also be used. However, nitrates are preferred from the viewpoints of, e.g., the reduction of the number of oxygens contained in a nitrite molecule, as compared with that of a nitrate, or the reduction of the formation of fine powder mists which are liable to be released out of the bag.

The function of the slag-forming agent is such as to cause alkali metal or alkaline earth metal oxides formed by the decomposition of particularly an oxidizing agent component contained in the gas generant composition to stay in a combustion chamber by converting them, e.g., into a solid form from a liquid form in order to prevent them from being released out of the inflater as mists, and the slag-forming agent can be selected and optimized depending upon the different metal components utilized.

A slag-forming agent selected from among at least one member of, e.g., naturally produced clay comprising aluminosilicate as a principal component (such as bentonite and kaolin), artificial clay (such as synthetic mica, synthetic kaolinite and synthetic smectite), talc (which is a member of the magnesium silicate hydrate minerals family) and silica can be used. Japanese acid clay can be cited as the preferred slag-forming agent.

With respect to the viscosity and the melting point of, e.g., the oxide mixture in a ternary system of calcium oxide generated from calcium nitrate, and aluminum oxide and silicon oxide which are principal components in clay, the viscosity varies from 3.1 poise to about 1000 poise in a range of from, 1350° C. to 1550° C. depending upon the composition ratio thereof, and the melting point varies from 1350° C. to 1450° C. depending upon the composition, respectively. A slag-formability can be exhibited according to the mixed composition ratio of the gas generant composition by using these properties.

Although the amount of the slag-forming agent to be used can be in the range of from 1 to 20% by weight, the range of from 3 to 7% by weight is preferable. When it is too much, reductions in the linear burning velocity and the gas generation efficiency are brought about; and when it is too little, slag-formability cannot be sufficiently exhibited.

The binder is an essential component for obtaining a required molded article of the gas generant composition, and many compounds can be used as long as they have viscosity in the presence of water and solvents and do not exert an adverse effect on the combustion mechanism of the composition to a large extent. Although polysaccharide derivatives such as metal salts of carboxymethyl celluloses, hydroxyethyl celluloses, cellulose acetates, cellulose propionates, cellulose acetate butyrates, nitrocelluloses and starches are cited as being useful, water-soluble binders are preferred in view of safety in production and easiness in handling. Metal salts of carboxymethyl celluloses, particularly sodium salts thereof can be cited as the most preferred examples.

The amount of the binder to be used falls within the range of from 3 to 12% by weight, and the range of from 4 to 12% by weight is still more preferable. Although the rupture strength of the molded article becomes stronger in the upper end of the range, such larger amounts are not preferable, since the larger the amount is, the larger the amount of the carbon element and the hydrogen element in the composition, and the larger the concentration of trace amounts of CO gas that are formed by an incomplete combustion of the carbon element, thereby reducing the quality of the gas being generated within the air bag. In particular, when the binder is present in amounts exceeding 12% by weight within the air bag, there is required an increase in the relative presence of the oxidizing agent, which in turn reduces the relative ratio of the gas generant compound, and therefore makes it difficult to achieve an inflater system which can be put to practical use.

Further, as the secondary effect, the sodium salt of the carboxymethyl cellulose has such an effect that by the presence of a molecular order micro mixing state of sodium nitrate formed by transmetallation with nitrates in producing the molded article using water as described later, it shifts the decomposition temperatures of nitrates which are the oxidizing agents, particularly strontium nitrate having a high decomposition temperature to a lower temperature side to raise the combustibility.

Accordingly, a preferred gas generant composition to be used in the practice of the present invention is a gas generant composition comprising:

(a) about 25 to 60% by weight, preferably 30 to 40% by weight of nitroguanidine, (b) about 40 to 65% by weight, preferably 45 to 65% by weight of an oxidizing agent, (c) about 1 to 20% by weight, preferably 3 to 7% by weight of a slag-forming agent, and (d) about 3 to 12% by weight, preferably 4 to 12% by weight of a binder.

A particularly preferred composition is a gas generant composition comprising:

(a) about 30 to 40% by weight of nitroguanidine, (b) about 40 to 65% by weight of strontium nitrate, (c) about 3 to 7% by weight of Japanese acid clay, and (d) about 4 to 12% by weight of the sodium salt of carboxymethyl cellulose.

According to the present invention, a gas-generant-molded-article for air bags is prepared by molding a composition having a linear burning velocity of from 1 to 12.5 mm/second into a cylindrical form having an opening hole, the composition comprising:

(a) about 25 to 60% by weight of nitroguanidine, (b) about 40 to 65% by weight of an oxidizing agent, (c) about 1 to 20% by weight of a slag-forming agent, and (d) about 3 to 12% by weight of a binder.

The amount of the nitrogen-containing agent to be used in the gas generant composition varies depending upon the number of the elements constituting the nitrogen-containing agent, its molecular weight, and the combination thereof with the oxidizing agent and other additives. It is preferable that the oxygen balance brought about by the combination thereof with the oxidizing agent and other additives is close to zero. However, an optimum composition-molded-article can be obtained by controlling the oxygen balance to a positive side or a negative side, depending upon the concentrations of generated CO and $NO_x$ that are present in trace amounts as described above.

Although oxidizing agents which have been well known in the field of gas generants for air bags can be used as the oxidizing agent in the present invention, fundamentally, the use of oxidizing agents having a property of forming a substance having a high melting point are preferable, since the thermal load exerted on a coolant and a filter agent is reduced by residual components that are in a liquid or gaseous state.

Although potassium nitrate, for example, is an oxidizing agent to be usually used for gas generants, it is not preferred in consideration of the thermal load exerted on the coolant and the filter agent as described above, since the main residual component in combustion is potassium oxide or potassium carbonate, the potassium oxide is decomposed into potassium peroxide and metal potassium at about 350° C., and further, the potassium peroxide has a melting point of 763° C. and becomes a liquid or gaseous state in the operational state of the gas generator.

Strontium nitrate can be cited as the specific oxidizing agent to be preferably used in the present invention. The main residual component of the strontium nitrate in combustion is strontium oxide having a melting point of 2430° C. and is almost in a solid state even in the operational state of the gas generator.

The amount of the oxidizing agent to be used in the present invention is not particularly restricted as long as it is an oxidizing-agent-amount sufficient for completely combusting the nitrogen-containing organic compound, and is suitably changeable in order to control the linear burning velocity and the calorific value. However, in the case where strontium nitrate is used as the oxidizing agent for dicyandiamide, it is preferably present in an amount of from 11.5 to 55% by weight.

Although one of the preferred gas generant compositions in the present invention includes one comprising 8 to 20% by weight of dicyandiamide, 11.5 to 55% by weight of strontium nitrate, 24.5 to 80% by weight of copper oxide, and 0.5 to 8% by weight of the sodium salt of carboxymethyl cellulose, the present invention also provides a gas generant composition comprising 8 to 20% by weight of dicyandiamide, 11.5 to 55% by weight of strontium nitrate, 24.5 to 80% by weight of copper oxide, and 0.5 to 8% by weight of the sodium salt of carboxymethyl cellulose.

In general, methods which have hitherto been known, for example, tablet molding, extrusion molding and the like can be applied in order to mold an explosive composition to have a specific thickness using a binder. However, in the case where the composition is used as a gas generant for air bags as in the present invention, it is preferable to form a molded article having a relatively thin thickness from the view point of the linear burning velocity, and in order to give a required strength, it is preferred that the molded article be molded into a cylindrical form having an opening hole therein or therethrough, and that this molding be carried out by applying an extruding and molding method.

In the present invention, by adding water thereto after the gas generant composition described above is subjected to dry blending, conducting slurry mixing until the mixture becomes sufficiently homogeneous, molding with an extruding-molding machine equipped with a die, cutting the extrudate to a suitable length and drying, a gas-generant-molded-article having such performance as to be sufficiently capable of being applied to air bag systems is obtained.

The gas generant can be processed into a cylindrical form having an opening hole as shown in FIG. 1 by cutting it to be a suitable length, after the molding while extruding. Further, in the extruding and molding method, it is possible to control the thickness by maintaining the outer diameter to a fixed level using a die and varying the inner diameter.

Employing such a form makes it possible to suppress heat generation and to combust from the outside and the inside of the cylinder, and thus an excellent linear burning velocity sufficient for applying to air bags can be obtained. Although the outer diameter (R), the inner diameter (d) and the length (L) of the cylindrical-molded-article having an opening hole can suitably be set up in a range where it can be applied to gas generators, it is desirable that the outer diameter be 6 mm or less and that the ratio (L/W) of the length (L) to the thickness $W=(R-d)/2$ is preferably 1 or more in consideration of the practicability and the burning velocity. The molded articles of the present invention can be combusted within a required combustion time even when the linear burning velocity is small, and an optional part for removing heat is not necessitated by using a slag-forming agent together therewith, which makes it possible to miniaturize the gas generator itself.

Next, a preferred embodiment to be practiced in the production process for obtaining the molded article to be used in the present invention will be explained.

First, a composition lump is prepared by a kneading operation using water of from 10 to 30% by weight based on the amount of the required final gas generant composition depending upon the grain size and the bulk density of the raw materials. The order of mixing is not particularly restricted, and any order by which safety is best maintained in production may be employed. Then, after removing excess water, if necessary, the composition lump is extruded through a die having a fixed form which gives a cylindrical form having an opening hole, and under a pressure condition of usually 40 to 80 kg/cm$^2$, 130 to 140 kg/cm$^2$ in some cases, to form a cylindrical string-formed matter. Further, before the surface of the string-formed matter is dried, it is cut to a required length by means of a cutter and then dried, whereby a desired molded article can be obtained having a hole opening. The linear burning velocity of the gas generant composition is determined by combusting it under a pressure of 70 kgf/cm$^2$ in a vessel having a volume of 1 liter substituting nitrogen therefor and analyzing the pressure change in the vessel recorded by means of a pressure sensor.

Although the form of the molded article is determined by the linear burning velocity of the final composition, in the compositions having linear burning velocities of about 10 mm/second and lower, it is preferable to form a cylindrical molded article having an opening hole therethrough of which the outer diameter is from 1.5 to 3 mm and the length is from 0.5 to 5 mm. Particularly in the composition comprising 35% by weight of nitroguanidine, 50% by weight of strontium nitrate, 5% by weight of Japanese acid clay, and 10% by weight of the sodium salt of carboxymethyl cellulose, it is preferred to form a cylindrical molded article having an opening hole therethrough, wherein the outer diameter of the molded article is from 2.2 to 2.75 mm, the inner diameter thereof is from 0.56 to 0.80 mm, and the length thereof is from 2.5 to 3.2 mm.

Furthermore, the present invention also provides an inflater system using a gas-generant-molded-article for air bags which has been prepared by subjecting a gas generant composition to a kneading operation, forming a composition lump therefrom after adding water or a solvent thereto, extruding the composition lump through a die in a pressure condition to form a cylindrical form having an opening hole, and cutting and drying it; wherein the gas generant composition comprises:

(a) about 25 to 60% by weight of a nitrogen-containing organic compound, (b) about 40 to 65% by weight of an oxidizing agent, (c) about 1 to 20% by weight of a slag-forming agent, and (d) about 3 to 12% by weight of a binder.

When the gas generant composition according to the present invention is used as an inflater system, particular restrictions are not put thereon. However, a combination with an inflater structure by which the characteristics of the gas generant composition are effectively indicated is the most suitable.

Accordingly, with the present invention it becomes possible to prepare a gas-generant-molded-article having a low calorific value and a high combustion performance by using gas generant compositions that have a small linear burning velocity. This is important, since hitherto such composition have not been able to provide satisfactory performances, even though attention has been paid thereto from the view point of safety.

Accordingly, a novel gas generant composition for air bags containing a nitrogen-containing organic compound and an oxidizing agent and a molded article using the same are provided by the present invention. Also, a way to miniaturize a gas generator for application to an air bag system has been achieved by the present invention.

EXAMPLES

The present invention will now be explained specifically with reference to examples and comparative examples. However, the present invention is not restricted to, or otherwise limited by these examples.

Example 1

To 35 parts (hereinafter, parts represent parts by weight) of high density nitroguanidine (hereinafter abbreviated as NQ), water corresponding to 15 parts based on the whole amount of the composition is added and they are blended and kneaded.

Separately, 50 parts of strontium nitrate, 5 parts of Japanese acid clay, and 10 parts of the sodium salt of carboxymethyl cellulose are blended in a dry condition, which are added to the wet mixed powder described above, followed by further kneading. Then, the kneaded mixture is extruded through a die having an outer diameter of 2.5 mm and an inner diameter of 0.80 mm under a pressure condition of 80 kg/cm$^2$, whereby a cylindrical string-formed matter having an opening hole therethrough is prepared. Further, this string-formed matter is cut to a length of 2.12 mm by a cutter, and thereafter its moisture is sufficiently dried out to give a gas-generant-molded-article. The results of the 60 liter tank test at room temperatures obtained by using 38 g of this gas-generant-molded-article are shown below. The linear burning velocity of the present gas generant composition was 8.1 mm/second.

The maximum pressure of the tank was 1.83 kg/cm$^2$ and the maximum pressure-reaching time was 55 milliseconds.

While, the mist amount in the tank was 700 mg or less, the inside of the tank was very clean, and the concentrations of the gases such as CO and $NO_x$ present in trace amounts fell within values generally required by car makers.

Examples 2 to 5 and Comparative Examples 1 to 3

The gas-generant-composition-molded-articles were prepared in the same manner as that in Example 1, except that the parts by weight of the respective components or the forms of the molded articles were changed as shown in Table 1.

TABLE 1

| | Nitrogen-Containing Organic Compound | Strontium Nitrate | Slag-Forming Agent | Binder | Outer Diameter × Inner Diameter × Length |
|---|---|---|---|---|---|
| Example 2 | NQ 28 | 55 | Japanese Acid clay 7 | CMC 10 | 2.5 × 0.8 × 2.14 |
| Example 3 | NQ 31 | 56 | Japanese Acid clay 3 | CMC 10 | 2.5 × 0.8 × 2.14 |
| Example 4 | NQ 29 | 54 | Japanese Acid clay 7 | CMC 10 | 2.2 × 0.56 × 3.0 |
| Example 5 | NQ 35 | 50 | Silica 5 | CMC 10 | 2.5 × 0.8 × 0.22 |
| Comparative Example 1 | NQ 38 | 52 | None | CMC 10 | 2.5 × 0.8 × 2.14 |
| Comparative Example 2 | NQ 52 | 46 | None | Starch 2 | 5.0 × — × 1.39 |
| Comparative Example 3 | NQ 32 | 58 | None | CMC 10 | 5.0 × — × 1.27 |

The linear burning velocities of the respective gas generant compositions of Examples 1 to 5 and Comparative Examples 1 to 3, and the total calorific values obtained when using the amounts of the compositions necessary for generating a fixed generated-gas-amount are shown in Table 2.

TABLE 2

| | Linear burning velocity (mm/second) | Total calorific value (kcal) |
|---|---|---|
| Example 1 | 8.1 | 28.2 |
| Example 2 | 10.0 | 33.3 |
| Example 3 | 9.4 | 31.9 |
| Example 4 | 9.3 | 30.2 |
| Example 5 | 10.5 | 29.4 |
| Comparative Example 1 | 7.3 | 31.1 |
| Comparative Example 2 | 7.8 | 27.8 |
| Comparative Example 3 | 8.5 | 31.1 |

The results of the tank test are shown in Table 3.

TABLE 3

| Composition | Amount of Composition | Tank Maximum Pressure | Maximum Pressure Reaching Time | Mist Amount | Gas Concentrations of, e.g., CO and $NO_x$ |
|---|---|---|---|---|---|
| Example 2 | 44.6 | 1.95 | 58 | Same as in Example 1 | $NO_x$ is higher than that in Example 1, but falls within allowable range |

TABLE 3-continued

| Composition | Amount of Composition | Tank Maximum Pressure | Maximum Pressure Reaching Time | Mist Amount | Gas Concentrations of, e.g., CO and $NO_x$ |
|---|---|---|---|---|---|
| Example 3 | 43.0 | 3.05 | 48 | Same as in Example 1 | CO and $NO_x$ levels are the lowest |
| Example 4 | 40.6 | 1.44 | 62 | Same as in Example 1 | $NO_x$ is further higher than that in Example 2 |
| Example 5 | 38.0 | 1.92 | 52 | Same as in Example 1 | Same as in Example 1 |
| Comparative Example 1 | 41.8 | 2.24 | 38 | Much mist, and dirty inside the tank | CO level is high |
| Comparative Example 2 | 37.4 | 0.52 | 50 | | Not sufficiently combusted |
| Comparative Example 3 | 41.9 | Inflater Vessel Broke | | | |

Example 6

Respective powders of 12 parts of dicyandiamide, 53 parts of strontium nitrate, 30 parts of copper oxide, and 5 parts of the sodium salt of carboxymethyl cellulose were mixed well in a dry condition, 12.5 parts of water was further added, and slurry mixing was carried out until it became sufficiently homogeneous. After the slurry mixing, molding while extruding was carried out at a molding pressure of 60 to 70 kgf/cm$^2$ and an extruding rate of 0.2 cm/minute by using an extruding and molding machine equipped with a die having an outer diameter of 1.6 mm and an inner diameter of 0.56 mm, followed by cutting to a length of about 5 mm. After the cutting, drying was carried out at 50° C. for 15 hours or more to give a gas generant composition (linear burning velocity 7.4 mm/second, the total calorific value 22.2 kcal). The gas generant composition was obtained at a weight yield of 80% or more. By using 54 g of this gas generant composition, a prescribed tank test (method described in JP-B-52-3620 and JP-B-64-6156) was carried out. A tank pressure of 1.22 kg/cm$^2$ and a maximum pressure-reaching time of 50 milliseconds were obtained, and the values falling in the required ranges where it could be put to practical use without damaging a metal-made heat removing agent and a filter were shown.

Example 7

A gas generant composition (linear burning velocity 7.6 mm/second, the total calorific value 22.1 kcal) was prepared in the same manner as that in Example 6 and the tank test was carried out in the same manner as that in Example 6, except that the addition amounts were changed to 10 parts of dicyandiamide, 35 parts of strontium nitrate, 50 parts of copper oxide, and 5 parts of the sodium salt of carboxymethyl cellulose, and the weight of the composition was 65 g. A tank pressure of 1.31 kg/cm$^2$ and a maximum pressure-reaching time of 55 milliseconds were obtained, and the values falling in the required ranges where it could be put to practical use without damaging the metal-made heat removing agent and the filter were shown.

Example 8

A gas generant composition was prepared in the same manner as that in Example 6, except that the addition amounts were changed to 13 parts of dicyandiamide, 32 parts of strontium nitrate, 50 parts of copper oxide, and 5 parts of the sodium salt of carboxymethyl cellulose, and the composition was molded to have an outer diameter of 1.15 mm, an inner diameter of 0.34 mm and a length of 0.52 mm. (linear burning velocity 6.1 mm/second, the total calorific value 22.2 kcal). By using 67 g of this molded article, the tank test was carried out in the same manner as that in Example 6. A tank pressure of 1.67 kg/cm$^2$ and a maximum pressure-reaching time of 47 milliseconds were obtained, and a result in which the performance-adjustable range was broader was obtained without damaging the metal-made heat removing agent and the filter.

Comparative Example 4

Slurry mixing was carried out with the same composition as that in Example 6, and after the slurry mixing, it was molded into a flaky pellet having a diameter of 5 mm and a thickness of 1 mm by a conventional stroke-molding machine. However, the weight yield of the flaky pellet was 20% or less based on the weight fed, and the pellet did not show a practicable strength.

Comparative Example 5

After adding 10 parts of water, the respective powders of 23 parts of dicyandiamide, 57 parts of strontium nitrate and 20 parts of copper oxide were mixed until the mixture became sufficiently homogeneous. After conditioning the humidity, it was molded into a flaky pellet (linear burning velocity 24.0 mm/second, the total calorific value 28.6 kcal) having a diameter of 5 mm and a thickness of 2 mm by a conventional stroke-molding machine. The tank test was carried out in the same manner as that in Example 5 by using 50 g of the composition. However, the filter was heavily damaged, and the required tank pressure could not be obtained.

Comparative Example 6

The composition was molded into a pellet (linear burning velocity 9.1 mm/second, the total calorific value 25.3 kcal) in the same manner as that in Comparative Example 2, except that the dicyandiamide was 19 parts, the strontium nitrate was 31 parts and the copper oxide was 50 parts, and the tank test was carried out in the same manner as that in Example 6 by using 60 g of the molded article. The combustion completion time was 100 milliseconds or more, and thus the requirements for a practical performance could not be satisfied.

The linear burning velocities of the respective gas generant compositions of Examples 6 to 8, and the total calorific values obtained when using the amounts of the compositions necessary for generating a fixed generated-gas-amount are shown in Table 4.

TABLE 4

| | Gas Generant Composition (Material Name/% by Weight) | | | Linear | Total | Amount of |
|---|---|---|---|---|---|---|
| | Nitrogen-Containing Organic Compound | Oxidizing Agent | Binder | Burning Velocity (mm/second) | Calorific Value (kcal) | Composition Needed (g) |
| Example 6 | DCDA/10 | $Sr(NO_3)_2$/45 CuO/40 | CMC/5 | 6.2 | 20.5 | 64.0 |
| Example 7 | DCDA/17 | $Sr(NO_3)_2$/48 CuO/30 | CMC/5 | 7.2 | 23.8 | 72.2 |
| Example 8 | DCDA/13 | $Sr(NO_3)_2$/35 CuO/50 | CMC/2 | 8.3 | 21.5 | 65.9 |

What is claimed:

1. A gas generant composition for air bags, comprising:

(a) about 30 to 40% by weight of nitroguanidine, (b) about 40 to 65% by weight of an oxidizing agent, and (c) about 3 to 12% by weight of a binder.

2. An inflater system containing as a gas generant therein, the gas generant composition for air bags as recited in claim 1.

3. A gas generant propellant composition for a vehicle air bag, which contains therein about 1–20 wt. % of Japanese acid clay, based on the total weight of the composition.

4. The gas generant propellant composition recited in claim 3, wherein said composition further contains 3–12 wt. % of a water soluble polysaccharide derivative, based on the total weight of the composition.

5. The gas generant composition for air bags as recited in claim 1, which further comprises (d) about 1 to 20% by weight of a slag-forming agent.

6. The gas generant composition for air bags as recited in claim 5, in which the slag-forming agent is selected from the group consisting of a naturally produced clay comprising aluminosilicate as the principal component, artificial clay and mica.

7. The gas generant composition for air bags as recited in claim 1 or 5, wherein the binder is a polysaccharide derivative selected from the group consisting of a metal salt of carboxymethyl cellulose, a hydroxyethyl cellulose, a cellulose acetate, a cellulose propionate, a cellulose acetate butyrate, a nitrocellulose and a starch.

8. The gas generant composition for air bags as recited in claim 1 or 5, wherein the oxidizing agent comprises an alkali metal nitrate or an alkaline earth metal nitrate.

9. The gas generant composition for air bags as recited in claim 5, comprising:

(a) about 30 to 40% by weight of nitroguanidine, (b) about 40 to 65% by weight of strontium nitrate, (c) about 3 to 7% by weight of Japanese acid clay and (d) about 3 to 12% by weight of sodium carboxymethyl cellulose.

10. The gas generant composition for air bags as recited in claim 5, in which the slag-forming agent comprises Japanese acid clay.

* * * * *